US006700318B2

(12) United States Patent
Baek

(10) Patent No.: US 6,700,318 B2
(45) Date of Patent: Mar. 2, 2004

(54) SPRING FOR CATHODE RAY TUBE

(75) Inventor: Jae-Seung Baek, Pusan (KR)

(73) Assignee: LG Electronics Inc., Seoul (KR)

( * ) Notice: Subject to any disclaimer, the term of this patent is extended or adjusted under 35 U.S.C. 154(b) by 181 days.

(21) Appl. No.: 09/832,337

(22) Filed: Apr. 11, 2001

(65) Prior Publication Data

US 2002/0000768 A1 Jan. 3, 2002

(30) Foreign Application Priority Data

Apr. 11, 2000 (KR) ..... 2000-19034
Mar. 29, 2001 (KR) ..... 2001-16504

(51) Int. Cl.[7] ..... H01J 29/80
(52) U.S. Cl. ..... 313/402; 313/404; 313/405
(58) Field of Search ..... 131/402, 404, 131/405, 406, 403, 407, 408

(56) References Cited

U.S. PATENT DOCUMENTS 4,315,189 A * 2/1982 Goto et al. ..... 313/405
4,491,763 A * 1/1985 Fujinuma et al. ..... 313/405
5,680,004 A * 10/1997 Ragland, Jr. ..... 313/405

OTHER PUBLICATIONS

CRC Handbook of Chemistry and Physics. Ed. David R Lide. 82[nd] Edition, 2001–2002. p 12–232.*

* cited by examiner

*Primary Examiner*—Vip Patel
*Assistant Examiner*—Sharlene Leurig
(74) *Attorney, Agent, or Firm*—Fleshner & Kim, LLP

(57) ABSTRACT

The present invention relates to a color cathode ray tube having a spring structure capable of compensating for the displacement of a shadow mask frame, thereby suppressing the degradation of the color purity according to the mislanding of electron beams. The spring according to the present invention includes a stud pin coupling part, a frame welding part and an inclined part as an elastic support body having a predetermined inclination angle between the stud pin coupling part and the frame welding part. Further, the spring is bonded to a plurality of metal members that have different thermal expansion coefficients, while being separated from each other in a length direction of the spring relative to a tube shaft.

16 Claims, 5 Drawing Sheets

【FIG. 1】
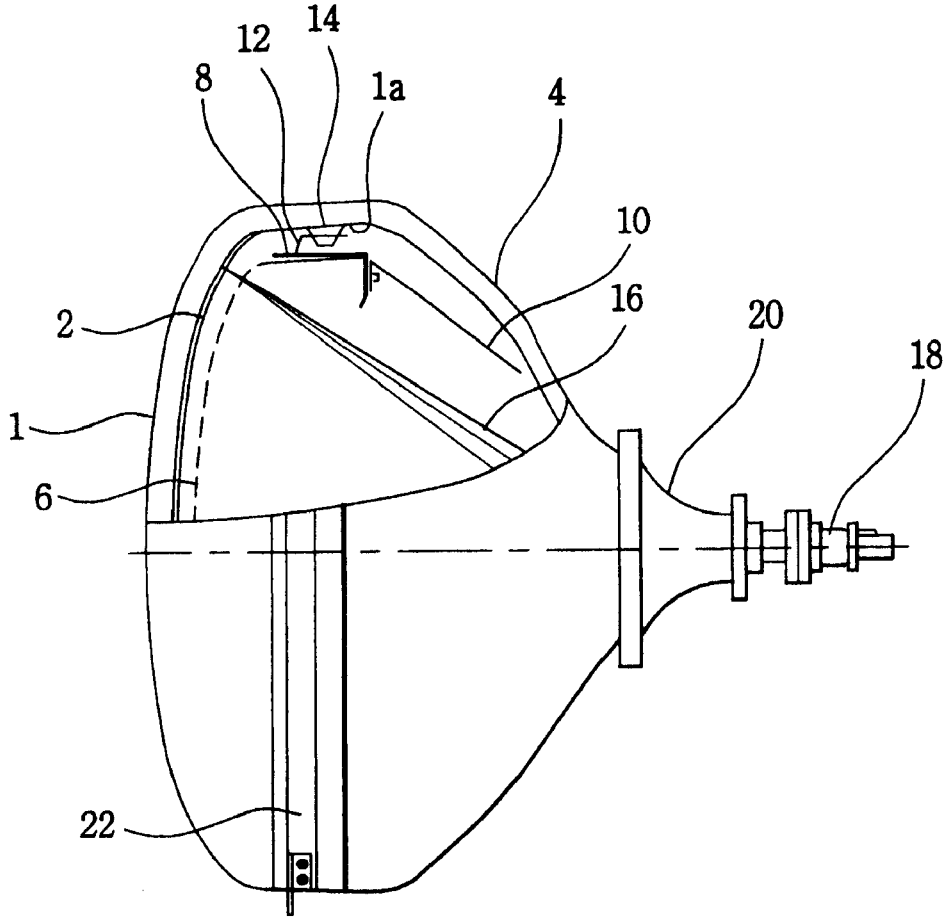
【FIG. 2】
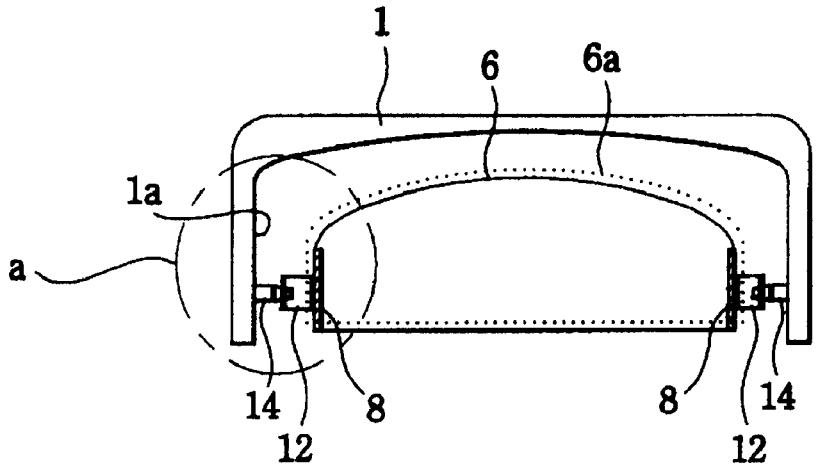

【FIG. 3】
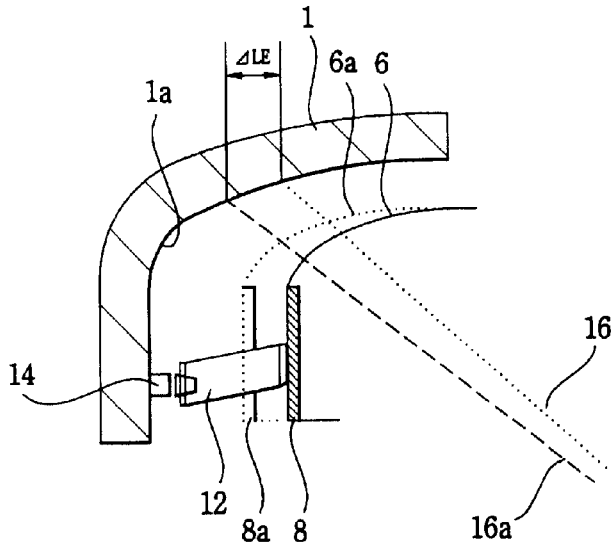
【FIG. 4a】
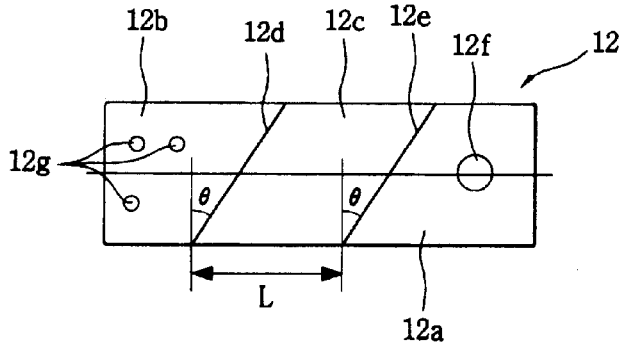
【FIG. 4b】
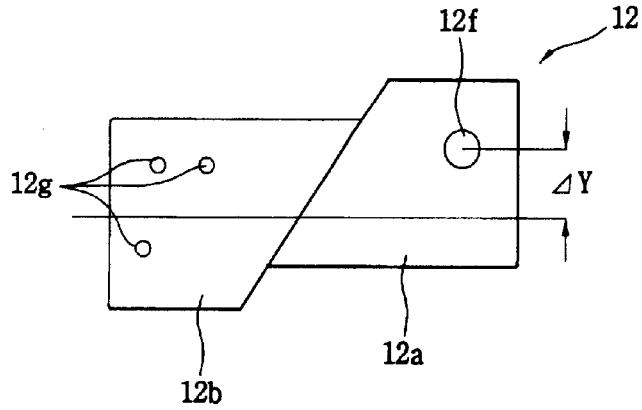

【FIG. 4c】
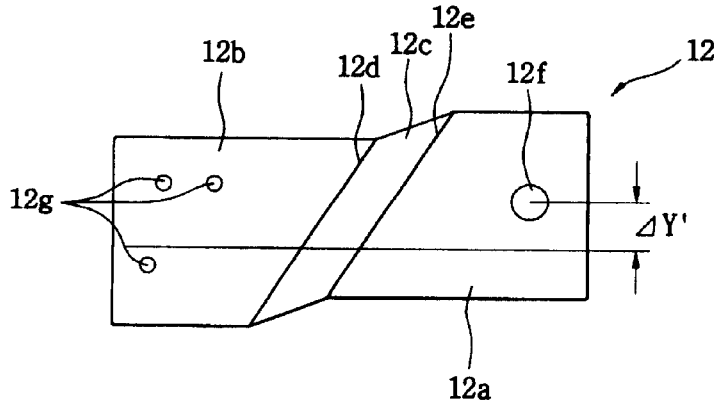
【FIG. 5】
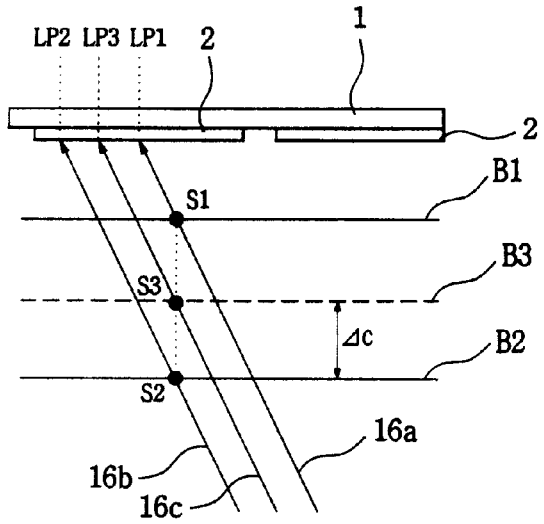
【FIG. 6】
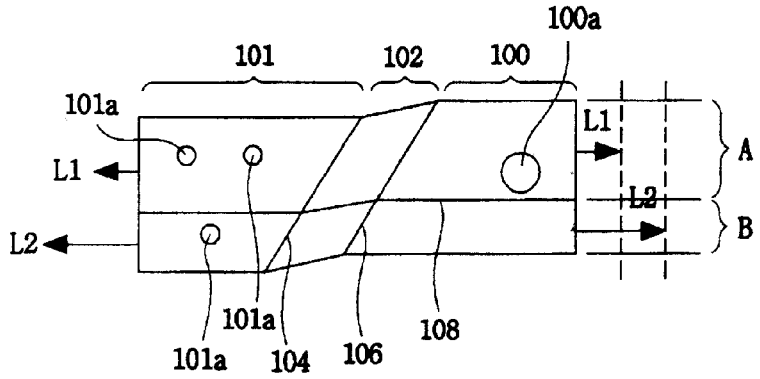

【FIG. 7】
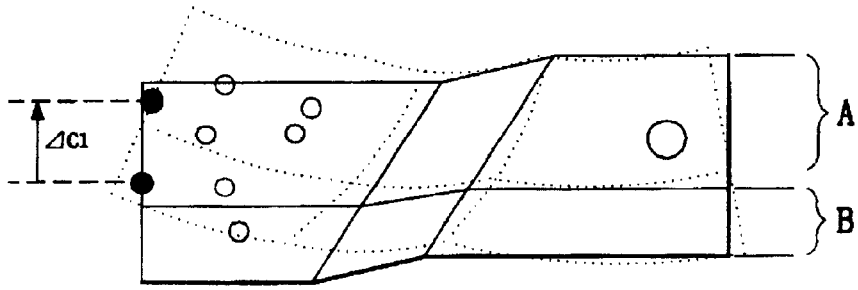
【FIG. 8】
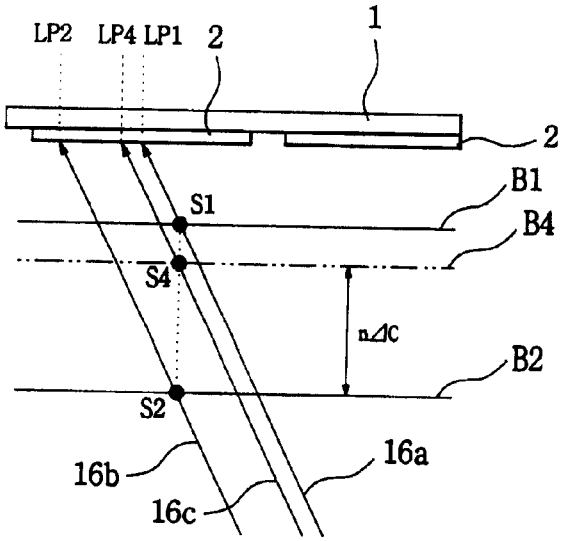
【FIG. 9】
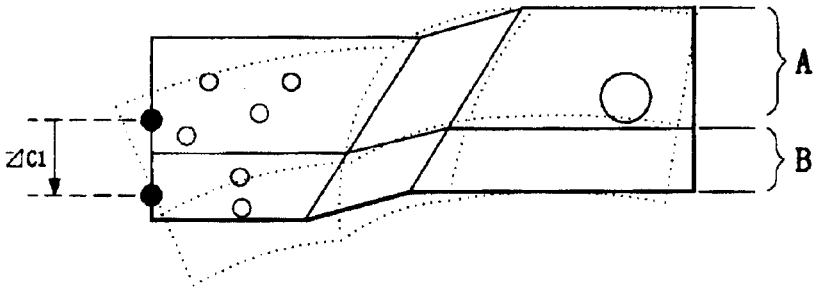

【FIG. 10】
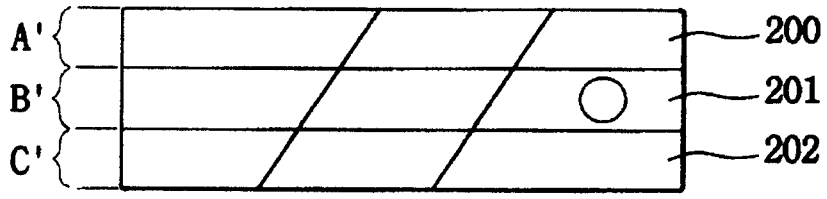
【FIG. 11】
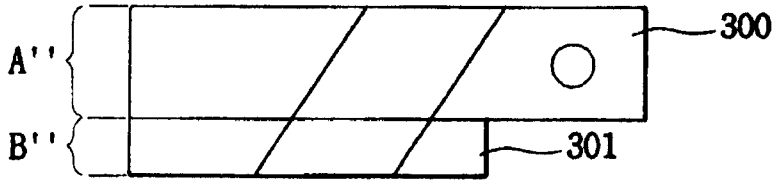

SPRING FOR CATHODE RAY TUBE

BACKGROUND OF THE INVENTION

1. Field of the Invention

The present invention relates to a spring for supporting a support frame of a shadow mask in a color cathode ray tube and more particularly, to a spring for a color cathode ray tube that is capable of compensating for the displacement of a shadow mask according to a thermal expansion of the support frame for the shadow mask, thereby preventing mislanding of electron beams that may be caused from the displacement of the shadow mask.

2. Description of the Related Art

With the development of the technology for a cathode ray tube, recently, a large-sized color cathode ray tube becomes popular, which causes weight of a support frame for a shadow mask to be increased. However, this causes an amount of shock resistance, upon dropping, to be undesirably increased, such that an excessive shock may be applied to a spring that is adapted to connect a stud pin of a panel with the shadow mask and to the shadow mask. This results in the deviation of the support frame for the shadow mask and the deformation of the shadow mask. In addition, the shadow mask suffers a thermal expansion, which evokes the change in the landing of the electron beams. This results in the degradation of the color purity.

Therefore, there is a need for an effective buffering against the shock applied upon a dropping test and the thermal expansion of the shadow mask, for the purpose of reducing the amount of the shock resistance and preventing the degradation of the color purity.

FIG. 1 is a partly cut sectional view illustrating a general color cathode ray tube.

As shown, the general cathode ray tube includes: a panel 1 formed on the front surface of the cathode ray tube and provided with a luminous fluorescent material 2 of colors R, G and B on the inside thereof; a funnel 4 fused on the rear end of the panel 1; a shadow mask 6 on which beam transmitting holes of a dot or slot shape are formed for separating the colors; a support frame 8 for supporting the shadow mask 6, such that the shadow mask 6 is separated by a predetermined interval from the panel 1; an earth magnetic shield 10 coupled to the support frame 8; a spring 12 coupled to the support frame 8, for buffering the shock applied to the shadow mask 6 due to a thermal expansion of the shadow mask; a stud pin 14 formed on the side wall 1*a* of the panel 1, for coupling the spring 12 to the panel 1; an electron gun 18 inserted into the neck of the funnel 4, for emitting electron beams 16 to the luminous fluorescent material 2; a deviation yoke 20 for adjusting the advancing orbits of the electron beams 16, such that the electron beams 16 are scanned to the luminous fluorescent material 2; and a reinforcing band 22 for preventing the width contraction caused from external shocks.

The spring 12, as shown in FIGS. 4*a* to 4*c* is comprised of: a stud pin coupling part 12*a* on which a hole 'h' adapted to be inserted and fixed into a stud pin 14 on the side wall 1*a* of the panel 1 is formed; a frame welding part 12*b* for coupling on the support frame 8; and an inclined part 12*c* coupled to the stud pin coupling part 12*a* and the frame welding part 12*b*, while being inclined at a predetermined angle and having folded faces 12*d* and 12*e* inclined at a predetermined angle (θ) on the coupled parts with the stud pin coupling part 12*a* and the frame welding part 12*b*.

Under the above construction, the electron beams of the colors R, G and B emitted from the electron gun 8 inserted into the neck of the funnel 4 are adjusted in the orbits thereof by means of the deflection yoke 20 and then passed through the beam transmitting holes of the shadow mask 6. Next, the electron beams are scanned horizontally and vertically in a sequential order to the luminous fluorescent material 2 of the colors R, G and B spread on the inside of the panel 1 to thereby emit the light from the luminous fluorescent material 2. As a result, image is formed and displayed.

At this time, only about 30% of the electron beams 16 emitted from the electron gun 18 are passed through the beam transmitting holes of the shadow mask 6 and those of the remainder 70% are scanned to the part where no hole is formed on the shadow mask 6.

A part of the electron beams 16 scanned on the shadow mask 6 is reflected. In this case, a part of the electron beams reflected is changed to shock energy and then absorbed on the shadow mask 6. The absorbed energy enables the movement of the molecules in the interior of the shadow mask 6 to be activated, which induces the friction among the molecules. The friction generates heat from the shadow mask 6.

As a consequence, the temperature of the shadow mask 6 rises and the volume thereof becomes expanded according to a thermal expansion coefficient of the material of the shadow mask 6. The result is shown in FIG. 2. As shown, the shadow mask 6 is expanded toward the luminous fluorescent material 2 relative to the direction of a tube shaft.

In the figure, a reference number '6' represents a position where the shadow mask 6 before the thermal expansion is fixed and '6*a*' represents a position where the shadow mask 6 after the thermal expansion is moved.

Under the above state, the heat generated from the shadow mask 6 is conducted to the support frame 8, whereby the temperature of the support frame 8 rises. This enables the support frame 8 to be thermally expanded. Hence, the support frame 8 is expanded toward the side wall 1*a* of the panel 1 and the shadow mask 6 expanded is moved to the direction opposite to the luminous fluorescent material 2 relative to the direction of the tube shaft.

If the volume of the support frame 8 is larger than that of the shadow mask 6, however, the shadow mask 6 is excessively moved to the direction opposite to the luminous fluorescent material 2 relative to the direction of the tube shaft, which results in the mislanding of the shadow mask 6. In this case, an amount of variation in the landing of the shadow mask 6 is ΔLE, as shown in FIG. 3.

In order to decrease the amount of variation in the landing ΔLE, the support frame 8 has to be made of a material having a low thermal expansion coefficient. However, this causes the cost of the product to be undesirably high. As an alternative, hence, the spring 12 is designed in many ways in the structure thereof, such that the position of the shadow mask 6 is corrected to decrease the amount of variation in the landing ΔLE.

FIG. 3 is an enlarged view of the part 'a' of FIG. 1. As shown, the hole, which is formed on the end of the one side of the spring 12, is inserted and coupled to the stud pin 14 formed on the center of the side wall 1*a* of the panel 1, and the end of the other side of the spring 12 is welded and coupled to the rectangular type of support frame 8. And, a skirt (which is not shown in the drawing) having an end portion folded along the periphery of the hole formation part (on which the beam transmitting holes of a dot or slot shape are formed, which is not shown in the drawing) of the shadow mask 6 is welded and fixed on the inner wall of the support frame 8.

In FIG. 3, a reference numeral 16*a* represents the electron beams moved by a predetermined interval from the orbits of the electron beams 16 and 8*a* represents the support frame 8 moved by a predetermined interval from the position thereof before the thermal expansion.

On the other hand, the spring 12 having the inclined folded faces is varied according to the thermal expansion of the support frame 8, such that the stage difference between the stud pin coupling part 12*a*, the frame welding part 12*b* and the inclined part 12*c* is generated.

FIG. 4*a* shows the spring 12 having the inclined folded faces at the state where the stud pin coupling part 12*a*, the frame welding part 12*b* and the inclined part 12*c* are disposed in parallel with each other in a length direction of the spring 12, that is, at the state where the stage difference between the stud pin coupling part 12*a*, the frame welding part 12*b* and the inclined part 12*c* in a width direction of the spring 12 is zero. Reference numerals 12*d* and 12*e* represent the folded parts where the folding is formed according to the change of the shape of spring 12, 12*f* represents the hole that is coupled to the stud pin 14, and 12*g* represents welding points to which the spring 12 is welded and fixed on the support frame 8.

FIG. 4*b* shows the spring 12 at the state where the frame welding part 12*b* and the inclined part 12*c* are folded perpendicularly ($\theta=90°$) along the folded part 12*d* and the inclined part 12*c* and the stud pin coupling part 12*a* are folded perpendicularly ($\theta=90°$) along the folded part 12*e* in the direction opposite to the folded part 12*d*, thereby forming a maximum stage difference therebetween.

FIG. 4*c* shows the spring 12 having the inclined folded faces at the state where the stage difference value corresponding to the intermediate value between the values in FIGS. 4*a* and 4*b* is obtained.

According to the spring that has the inclination angle at which the stage difference is generated according to the thermal expansion, an amount of variation of the frame welding part 12*b* relative to the center of the hole 12*f* of the stud pin coupling part 12*a* is given by the following equation (1):

$$\Delta Y=(L\times\sin\theta)/2$$

wherein, the 'L' denotes the length of the inclined part 12*c* and the '$\theta$' denotes the inclination angle of the inclined part 12*c*.

In FIG. 4*c*, the '$\Delta Y$' represents an amount of displacement of the frame welding part 12*b* relative to the center of the hole 12*f* of the stud pin coupling part 12*a* at the time when the stage difference corresponding to the intermediate value is generated.

FIG. 5 is an exemplary view illustrating the variation in the landing of the electron beams relative to the displacement of the conventional shadow mask. A symbol 'B1' denotes an initial position of the shadow mask at an initial state, 'B2' denotes the position of the shadow mask after the thermal expansion, 'B3' denotes the position of the shadow mask after the correction action of the spring. Reference numerals 16*a*, 16*b* and 16*c* represent the electron beams, symbols LP1, LP2 and LP3 represent the landing points of the electron beams, and symbols S1, S2 and S3 represent the positions where the electron beams are passed through the beam transmitting holes of the shadow mask.

Before the shadow mask 6 is thermally expanded, it is disposed on the position B1 and the electron beams 16*a* are passed through the position S1 to scan the luminous fluorescent material 2. At this time, the landing point of the electron beams 16*a* is the LP1.

Under the above state, when the support frame 8 for the shadow mask 6 is expanded, the shadow mask 6 is moved to the direction opposite to the luminous fluorescent material 2 relative to the tube shaft and thus disposed on the position B2. And, the electron beams 16*b* are passed through the position S2 to scan the luminous fluorescent material 2. At this time, the landing point of the electron beams 16*b* is the LP2.

At this state, if the position of the support frame 8 for the shadow mask is corrected by the elastic operation of the spring 12 having the inclined folded faces, the shadow mask 6 is moved toward the luminous fluorescent material 2 and thus placed on the position B3. Thus, the electron beams 16*c* are passed through the position S3 to scan the luminous fluorescent material 2. At this time, the landing point of the electron beams 16*c* is the LP3.

The position of the shadow mask 6 is corrected by an amount of correction of the position $\Delta C$, with a consequence that the mislanding corresponding to the difference of the landing points (LP1–LP2) is corrected by the difference of the landing points (LP3–LP2).

The amount of correction of the position $\Delta C$ is determined upon parameters such as the folded angle of the spring 12 having the inclined folded faces, the number of folded faces, the thermal expansion coefficient of the support frame 8, the material of the shadow mask 6. Thus, the value of the amount of correction of the position is not constant.

Therefore, the dimension of the spring in the conventional cathode ray tube is determined in consideration of the above parameters, but it is difficult to obtain the spring having an optimum dimension due to the strength of the spring and the work process thereof, which causes the mislanding of the electron beams due to the thermal expansion of the support frame for the shadow mask.

Hence, the spring in the conventional cathode ray tube forms inclined faces folded at a predetermined angle at the coupling parts thereof, such that it can absorb a part of the shock according to the increment of the weight of the shadow mask, thereby achieving a good buffering effect against an external shock. However, the degradation of the color purity caused due to the variation of the landing of the electron beams according to the thermal expansion of the support frame for the shadow mask can't be corrected.

SUMMARY OF THE INVENTION

Accordingly, it is an object of the present invention to provide a color cathode ray tube having a spring structure capable of compensating for the displacement of a shadow mask frame, thereby suppressing the degradation of the color purity according to the mislanding of electron beams.

To accomplish this and other objects of the present invention, there is provided a color cathode ray tube that comprises a spring formed by bonding a plurality of metal members having different thermal expansion coefficients in a length direction relative to a tube shaft.

BRIEF DESCRIPTION OF THE DRAWINGS

FIG. 1 is a partly cut sectional view illustrating a general color cathode ray tube;

FIG. 2 is an exemplary view illustrating a thermally expanded state of the shadow mask of the general color cathode ray tube;

FIG. 3 is an enlarged view of a part 'a' in FIG. 2;

FIG. 4*a* is a plan view illustrating the state before a conventional spring having inclined folded faces is changed due to a thermal expansion;

FIG. 4*b* is a plan view illustrating the state before a conventional spring having inclined folded faces is changed to a maximum extent due to a thermal expansion;

FIG. 4*c* is a perspective view illustrating the state before a conventional spring having inclined folded faces is partially changed due to a thermal expansion;

FIG. 5 is an exemplary view illustrating the variation in the landing of the electron beams relative to the displacement of the conventional shadow mask;

FIG. 6 is a plan view illustrating a structure of a spring according to a first embodiment of the present invention;

FIG. 7 is a plan view illustrating the operation of the spring in FIG. 6;

FIG. 8 is an exemplary view illustrating the variation in the landing of the electron beams relative to the displacement of the shadow mask according to the first embodiment of the present invention;

FIG. 9 is a plan view illustrating an operation of a spring according to a second embodiment of the present invention;

FIG. 10 is a plan view illustrating a structure of a spring according to a third embodiment of the present invention; and FIG. 11 is a plan view illustrating a structure of a spring according to a fourth embodiment of the present invention.

DETAILED DESCRIPTION OF THE PREFERRED EMBODIMENTS

The preferred embodiments of the present invention will be in detail discussed with reference to FIGS. 6 to 11.

FIG. 6 is a plan view illustrating a structure of a spring according to a first embodiment of the present invention. A reference numeral 101*a* represents a welding point welded and fixed on the support frame 8.

A spring according to the present invention is comprised of a stud pin coupling part 100, an inclined part 102 as an elastic support body and a frame welding part 101. Further, the spring includes folded parts 104 and 106 on the boundary parts between the stud pin coupling part 100 and the inclined part 102 and between the frame welding part 101 and the inclined part 102. Specifically, the spring is bonded with a pair of metal members A and B having different thermal expansion coefficients up and down in a width direction thereof, thereby forming a boundary line 108 between the pair of metal members.

The stud pin coupling part 100 of the first metal member A is provided with a hole 100*a* that is inserted and fixed into the stud pin 14.

The first metal member A forms a low thermal expansion part having a low thermal expansion coefficient and the second metal member B forms a high thermal expansion part having a relatively high thermal expansion coefficient.

Preferably, the low thermal expansion part of the first metal member A has a thermal expansion coefficient of $2–4\times10e^{-6}/°$ C. and the high thermal expansion part of the second metal member B has a thermal expansion coefficient of $10–18\times10e^{-6}/°$ C. The ratio of the thermal expansion coefficients between the high thermal expansion part and the low thermal expansion part is in a range of 2.5 to 9. If the thermal expansion coefficient ratio is less than 2.5, an amount of movement for doming compensation for an external temperature is small, such that an improvement on the characteristic should be required. To the contrary, if the thermal expansion coefficient ratio is more that 9, a problem on the characteristic upon a last normal doming arises due to an excessive compensation.

Also, the thickness of the first and second metal members A and B is in a range of 0.3 mm to 0.6 mm. If the thickness is too thin, a problem during a work process arises and contrarily, if the thickness is too thick, bonding strength becomes strong, which causes some problems in an attaching and detaching machine of a frame.

In more detail, the first metal member A is made of Invar, a steel and nickel alloy, of 0.5 t as a low thermal expansion material and the second metal member B is made of aluminum-killed steel (AK) Sus603 of 0.5 t. In this case, the thermal expansion coefficient of the Sus603 as the high thermal expansion material is $11.5\pm5\times10e^{-6}/°$ C. and the thermal expansion coefficient of the Invar (steel-nickel alloy) as the low thermal expansion is $2.5\pm5\times10e^{-6}/°$ C. And, the thermal expansion coefficient ratio is about 4.6. Of course, the above design can be easily obtained and the first and second metal members are appropriately selected in consideration of strength and molding characteristics.

Further, the design of the first and second metal members is made to prevent an excessive compensation in consideration of the variation of the external temperature and to minimize a reverse compensation according to a thermal change upon a normal doming.

The materials of the first and second metal members are welded with the same dimension ratio of 1:1 in consideration of the easiness of the working process and the bonding strength, which acts as an important factor in determining displacement capability.

The first metal member A is made of Invar as an alloy of steel and nickel, thereby forming a low thermal expansion part having a low thermal expansion coefficient, and the second metal member B is made of aluminum-killed steel AK, thereby forming a high thermal expansion part having a relatively high thermal expansion coefficient.

Now, an explanation of the operation effect of the spring of the present invention will be discussed.

When the support frame 8 of the shadow mask is heated by the stroke of the electron beams and thus expanded, the first metal member A is expanded by L1 in a length direction of the both sides of the spring, as shown in FIG. 6. And, the second metal member B having a higher thermal expansion coefficient than the first metal member A is expanded by L2 in a length direction of the both sides of the spring. It can be appreciated that the length difference value $2\times(L2–L1)$ between the two metal members is generated.

The length difference between the two metal members enables the spring to be bent toward the first metal member A having a low thermal expansion coefficient, as shown by the dotted line in FIG. 7. The hole 100*a* of the stud pin coupling part 100 is fixed by means of the stud pin, such that the frame welding part 101 exhibits a relatively large displacement. At this time, an amount of the displacement is $\Delta C1$ in a width direction of the spring.

FIG. 8 is an exemplary view illustrating the variation in the landing of the electron beams relative to the displacement of the shadow mask according to the first embodiment of the present invention. Same references are applied to the same parts as in FIG. 5. In the figure, a symbol 'B1' denotes an initial position of the shadow mask at an initial state, 'B2' denotes the position of the shadow mask after the thermal expansion, 'B3' denotes the position of the shadow mask after the correction action of the spring. Reference numerals 16*a*, 16*b* and 16*c* represent the electron beams, symbols LP1, LP2 and LP3 represent the landing points of the electron beams, and symbols S1, S2 and S3 represent the positions where the electron beams are passed through the beam transmitting holes of the shadow mask.

As noted above, if the frame coupling part 101 is bent by the difference of the thermal expansion coefficients of the spring, as shown in FIG. 8, an amount of position compensation having a predetermined value according to the difference of the thermal expansion coefficients of the spring is added to the amount of position compensation ΔC according to the folding of the spring, whereby a total amount of position compensation is nΔC. At this time, the landing point of the electron beams is moved from LP2 to LP4. This results in the compensation for the mislanding corresponding to the value LP2–LP4, which enables the electron beams to be optimally landed.

On the other hand, an operation of a spring according to a second embodiment of the present invention will be followed.

When the support frame 8 of the shadow mask is heated by the stroke of the electron beams and thus expanded, the shadow mask is passed through the optimal position B1 and then moved toward the luminous fluorescent material 2, if the position compensation of the shadow mask exceeds by the action of the spring. In this case, since the landing point of the electron beams is deviated to the right direction of the LP1, the position of the shadow mask should be compensated in a direction opposite to the luminous fluorescent material 2 relative to the tube shaft.

To solve such a problem, the spring according to the second embodiment of the present invention has the first metal member A made of aluminum-killed steel AK, thereby forming a high thermal expansion part having a relatively high thermal expansion coefficient and the second metal member B made of Invar as an alloy of steel and nickel, thereby forming a low thermal expansion part having a low thermal expansion coefficient.

According to the spring constructed as the above, as shown in FIG. 9, the difference of the thermal expansion coefficients between the two metal members causes the high thermal expansion part to be bent toward the low thermal expansion part in the opposite direction to the luminous fluorescent material relative to the tube shaft. At this time, an amount of the displacement of the shadow mask is −ΔC1 in a width direction of the spring.

Therefore, the landing point that is deviated to the direction of the LP1 is compensated in the direction of the LP2.

With the spring having the inclination angle θ and the folded faces 104 and 106, it can be understood that the two metal members having different thermal expansion coefficients are employed such that an amount of the displacement of the shadow mask relative to the tube shaft is adjusted.

FIG. 10 is a plan view illustrating a structure of a spring according to a third embodiment of the present invention, wherein three metal members A', B' and C' having different thermal expansion coefficients are bonded to each other in a length direction of the spring.

FIG. 11 is a plan view illustrating a structure of a spring according to a fourth embodiment of the present invention, wherein two metal members A" and B" having different thermal expansion coefficients are bonded in a length direction of the spring. In this case, the metal member B" is relatively shorter than the metal member A". The amount of displacement of the spring can be adjusted in a width direction thereof according to the dimension of the metal member B" on the lower side thereof.

As described above, a color cathode ray tube according to preferred embodiments of the present invention is provided with a spring that is constructed by bonding at least two or more metal members having different thermal expansion coefficients in a length direction of the spring, thereby forming at least one or more inclined folded faces, such that the elastic force of the spring is varied by the difference of the thermal expansion coefficients between the metal members bonded.

Thereby, the deviation of the position of the support frame of the shadow mask caused by the thermal expansion can be corrected, such that the degradation of the color purity caused during an optimal landing state of the electron beams is maintained can be prevented.

In addition, the spring according to the present invention exhibits an excellent shock resistance characteristic, such that the deformation of the shadow mask caused due to an external shock such as a dropping shock can be prevented.

What is claimed is:

1. A color cathode ray tube, comprising:

a panel having a luminous fluorescent material formed on an inside surface thereof;

a shadow mask separated by a predetermined interval from said luminous fluorescent material of said panel; and a spring having one end coupled to a stud pin on an inside of a skirt of said panel and the other end coupled to a support frame for supporting said shadow masks, said spring having a length extending in a direction between the stud pin and the support frame, a width extending in a direction perpendicular to the length, and a depth, wherein the length is longer than the width and the width is wider than the depth, and wherein the spring comprises:

a stud pin coupling part where the one end of said spring is coupled to said stud pin;

a frame welding part where the other end of said spring is coupled to said support frame; and an inclined part extending at a predetermined inclination angle between said stud pin coupling part and said frame welding part, wherein said inclined part comprises a plurality of metal members that have different thermal expansion coefficients, wherein each of the plurality of metal members is substantially in contact with another of the plurality of metal members along a lengthwise edge thereof; and wherein said inclined part includes a diagonal portion twisted in a lengthwise direction.

2. The color cathode ray tube according to claim 1, wherein each of the plurality of metal members is formed in a lengthwise direction substantially parallel to the other metal members and the metal member having the lowest thermal expansion coefficient is disposed in a direction on a panel side.

3. The color ray tube according to claim 1, wherein each of the plurality of metal members is formed in a lengthwise direction substantially parallel to the other metal members and the metal member having the highest thermal expansion coefficient is disposed on a panel side.

4. The color cathode ray tube according to claim 1, wherein said plurality of metal members comprises a first metal member having a thermal expansion coefficient of approximately 2×10−6/° C. to approximately 4×10−6/° C. and a second metal member having a thermal expansion coefficient of approximately 10×10−6/° C. to approximately 18×10−6/° C.

5. The color cathode ray tube according to claim 1, wherein the ratios of a first thermal expansion coefficient (T2) of a low thermal expansion coefficient metal member and a second thermal expansion coefficient (T2) of a high thermal expansion coefficient metal member are in a range of 2.5<T2/T1 <9.

6. The color cathode ray tube according to claim 1, wherein each of said plurality of metal members has a thickness in a range of 0.3 mm to 0.6 mm.

7. The color cathode ray tube according to claim 1, wherein a first of the plurality of metal members has a thermal expansion coefficient of approximately $2\times10^{-6}$/° C. to approximately 3×10−6/° C. and a second of the plurality of metal members has a thermal expansion coefficient of approximately $11\times10^{-6}$/° C. to approximately 12×10−6/° C.

8. The color cathode ray tube according to claim 1, wherein said plurality of metal members have different lengths from each other.

9. The color cathode ray tube according to claim 1, wherein at least one of said plurality of metal members comprises a metal with a low thermal expansion coefficient below 4×10−6/° C. and at least one of said plurality of metal members comprises an aluminum-killed steel with a high thermal expansion coefficient.

10. The color cathode ray tube according to claim 1, wherein the plurality of metal members comprises two metal members:

an Invar steel-nickel alloy material metal member; and an aluminum-killed steel metal member.

11. The color cathode ray tube according to claim 10, wherein the two metal members are substantially in contact with each other along the length of each metal member.

12. (Previously Added) The color cathode ray tube according to claim 1, wherein each of the plurality of metal members has a different width from another metal member in the spring.

13. The color cathode ray tube according to claim 1, wherein the plurality of metal members comprises three metal members and wherein each of the metal members is substantially in contact with at least one other metal member along a lengthwise edge of each metal member.

14. The color cathode ray tube according to claim 13, wherein the three metal members are aligned adjacent to each other along a plane in the width direction and wherein each of the metal members has a different thermal coefficient of expansion.

15. A cathode ray tube, comprising:

a panel;

a funnel connected to a rear portion of the panel;

a shadow mask;

a frame coupled to the shadow mask; and a spring coupled to the frame and the panel, wherein the spring has a length, a width and a depth, and wherein the spring includes a diagonal portion twisted in a lengthwise direction and comprises:

a plurality of metal members, wherein at least one of the plurality of metal members comprises an aluminum-killed steel.

16. The device as claimed in claim 15, wherein the aluminum-killed steel metal member has a thermal expansion coefficient 2.5 to 9 times greater than the thermal expansion coefficient of another of the plurality of metal members.

* * * * *